US009371997B2

(12) United States Patent
LeBegue et al.

(10) Patent No.: US 9,371,997 B2
(45) Date of Patent: Jun. 21, 2016

(54) SYSTEM FOR SUPPORTING A BUNDLED TUBE FUEL INJECTOR WITHIN A COMBUSTOR

(71) Applicant: General Electric Company, Schenectady, NY (US)

(72) Inventors: Jeffrey Scott LeBegue, Simpsonville, SC (US); Patrick Benedict Melton, Horse Shoe, NC (US); James Harold Westmoreland, III, Greer, SC (US); James Scott Flanagan, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 505 days.

(21) Appl. No.: 13/932,301

(22) Filed: Jul. 1, 2013

(65) Prior Publication Data

US 2015/0000286 A1 Jan. 1, 2015

(51) Int. Cl.
*F23R 3/28* (2006.01)

(52) U.S. Cl.
CPC . *F23R 3/28* (2013.01); *F23R 3/283* (2013.01); *F23R 3/286* (2013.01); *F23R 2900/00017* (2013.01)

(58) Field of Classification Search
CPC ..... F23R 3/28; F23R 3/283; F23R 3/286; F23R 3/34; F23R 2900/00017
USPC ..... 60/742, 740, 739, 734, 746, 747
See application file for complete search history.

(56) References Cited

U.S. PATENT DOCUMENTS

| | | | | | |
|---|---|---|---|---|---|
| 4,408,461 | A * | 10/1983 | Bruhwiler | F23R 3/32 | 60/737 |
| 5,274,991 | A | 1/1994 | Fitts | | |
| 6,298,667 | B1 | 10/2001 | Glynn | | |
| 6,928,823 | B2 * | 8/2005 | Inoue | F02C 7/22 | 60/737 |
| 8,122,721 | B2 | 2/2012 | Johnson | | |
| 8,205,452 | B2 * | 6/2012 | Boardman | F23R 3/12 | 60/737 |
| 2007/0151255 | A1 * | 7/2007 | Johnson | F23D 14/48 | 60/776 |
| 2009/0188255 | A1 | 7/2009 | Green | | |
| 2010/0084490 | A1 | 4/2010 | Zuo et al. | | |
| 2010/0162708 | A1 * | 7/2010 | Erickson | F02C 7/232 | 60/734 |
| 2010/0186413 | A1 * | 7/2010 | Lacy | F23R 3/10 | 60/740 |
| 2010/0218501 | A1 * | 9/2010 | York | F23R 3/286 | 60/737 |
| 2010/0287942 | A1 | 11/2010 | Zuo et al. | | |
| 2014/0260315 | A1 | 9/2014 | Westmoreland | | |
| 2015/0000284 | A1 | 1/2015 | LeBegue et al. | | |

* cited by examiner

*Primary Examiner* — Steven Sutherland
(74) *Attorney, Agent, or Firm* — Dority & Manning, PA

(57) ABSTRACT

A combustor includes an end cover having an outer side and an inner side, an outer barrel having a forward end that is adjacent to the inner side of the end cover and an aft end that is axially spaced from the forward end. An inner barrel is at least partially disposed concentrically within the outer barrel and is fixedly connected to the outer barrel. A fluid conduit extends downstream from the end cover. A first bundled tube fuel injector segment is disposed concentrically within the inner barrel. The bundled tube fuel injector segment includes a fuel plenum that is in fluid communication with the fluid conduit and a plurality of parallel tubes that extend axially through the fuel plenum. The bundled tube fuel injector segment is fixedly connected to the inner barrel.

19 Claims, 12 Drawing Sheets

SYSTEM FOR SUPPORTING A BUNDLED TUBE FUEL INJECTOR WITHIN A COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a combustor such as may be incorporated into a gas turbine or other turbomachine. Specifically, the invention relates to a combustor having a system for supporting a bundled tube fuel injector within the combustor.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section progressively increases the pressure of the working fluid and supplies a compressed working fluid to the combustion section. A fuel is mixed with the compressed working fluid within the combustion section and the mixture is burned in a combustion chamber defined within the combustion section to generate combustion gases having a high temperature and pressure. The combustion gases flow to the turbine section where they expand to produce work. For example, expansion of the combustion gases in the turbine section may rotate a shaft connected to a generator to produce electricity.

The combustion section may include one or more combustors annularly arranged between the compressor section and the turbine section. In a particular combustor design, the combustors include one or more axially extending bundled tube fuel injectors disposed downstream from an end cover. The end cover generally includes one or more fuel circuits that provide fuel to a fluid conduit that provides for fluid communication between the fuel circuits and a fuel plenum defined within each bundled tube fuel injector. Each bundled tube fuel injector generally includes a plurality of parallel tubes arranged radially and circumferentially across the bundled tube fuel injector. The parallel tubes extend generally axially through the fuel plenum to provide for fluid communication through the fuel plenum and into the combustion chamber. The compressed working fluid is routed through inlets of each of the parallel tubes. Fuel is supplied to the fuel plenum through the fluid conduit and the fuel is injected into the tubes through one or more fuel ports defined within each of the tubes. The fuel and compressed working fluid mix inside the tubes before flowing out of the tubes and into the combustion chamber for combustion.

Typically, one end of the fluid conduit is rigidly bolted to the end cover and a second end is fixedly or rigidly connected to the bundled tube fuel injector, thereby creating an end loaded cantilevered mass. As a result, the fluid conduit generally carries the majority of the load created by the cantilevered bundled tube fuel injector at the end cover and fluid conduit connection.

The bundled tube fuel injector is typically heavier or has a greater mass than a conventional fuel nozzle structure which may also be cantilevered. As the combustor cycles through various operating modes, the cantilevered bundled tube fuel injector may vibrate at various frequencies which may result in large deflections of the fluid conduit, thereby causing undesirable bending stresses at the end cover and fluid conduit connection. Therefore, an improved system for mounting and/or supporting a bundled tube fuel injector within a combustor would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor. The combustor includes an end cover that is disposed at one end of the combustor. The end cover includes an outer side and an inner side. The combustor further includes an outer barrel having a forward end that is adjacent to the inner side of the end cover and an aft end that is axially spaced from the forward end. An inner barrel is at least partially disposed concentrically within the outer barrel and is fixedly connected to the outer barrel. A fluid conduit extends downstream from the end cover. A first bundled tube fuel injector segment is disposed concentrically within the inner barrel. The bundled tube fuel injector segment includes a fuel plenum that is in fluid communication with the fluid conduit and a plurality of parallel tubes that extend axially through the fuel plenum. The bundled tube fuel injector segment is fixedly connected to the inner barrel.

Another embodiment of the present invention is a combustor. The combustor includes an end cover that is disposed at one end of the combustor. The end cover at least partially defines a fuel feed passage that extends axially therethrough. An outer barrel extends axially away from the end cover within the combustor. An inner barrel extends within the outer barrel and is fixedly connected to the outer barrel. A bundled tube fuel injector segment is disposed concentrically within the inner barrel. The bundled tube fuel injector segment includes a fuel plenum and a plurality of parallel tubes that extend axially through the fuel plenum. The bundled tube fuel injector segment is fixedly connected to the inner barrel. The combustor further includes a fluid conduit that provides for fluid communication between the fuel feed passage and the fuel plenum. The fluid conduit includes a first portion that extends within the fuel feed passage and a second portion that is fixedly connected to the bundled tube fuel injector segment. The first portion is slidable within the fuel feed passage to allow for thermal growth of the fluid conduit.

The present invention may also include a gas turbine. The gas turbine includes a compressor, a combustor that is at least partially surrounded by an outer casing disposed downstream from the compressor and a turbine that is disposed downstream from the combustor. The combustor comprises an end cover that is coupled to the outer casing and that includes an outer side, an inner side and a fuel feed passage that extends through the outer and the inner sides. A center fuel nozzle extends downstream from the inner side. An outer barrel extends axially away from the end cover within the combustor. An inner barrel extends within the outer barrel and at least partially surrounds the center fuel nozzle. The inner barrel is fixedly connected to the outer barrel. A bundled tube fuel injector segment is disposed between the center fuel nozzle and the inner barrel. The bundled tube fuel injector segment includes a fuel plenum and a plurality of parallel tubes that extend axially through the fuel plenum. The bundled tube fuel injector segment is fixedly connected to the inner barrel. The combustor further includes a fluid conduit that provides for fluid communication between the fuel feed passage and the fuel plenum. The fluid conduit includes a first portion that extends within the fuel feed passage and a second portion that is fixedly connected to the bundled tube fuel injector segment. The first portion is slidable within the fuel feed passage to allow for thermal growth of the fluid conduit.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
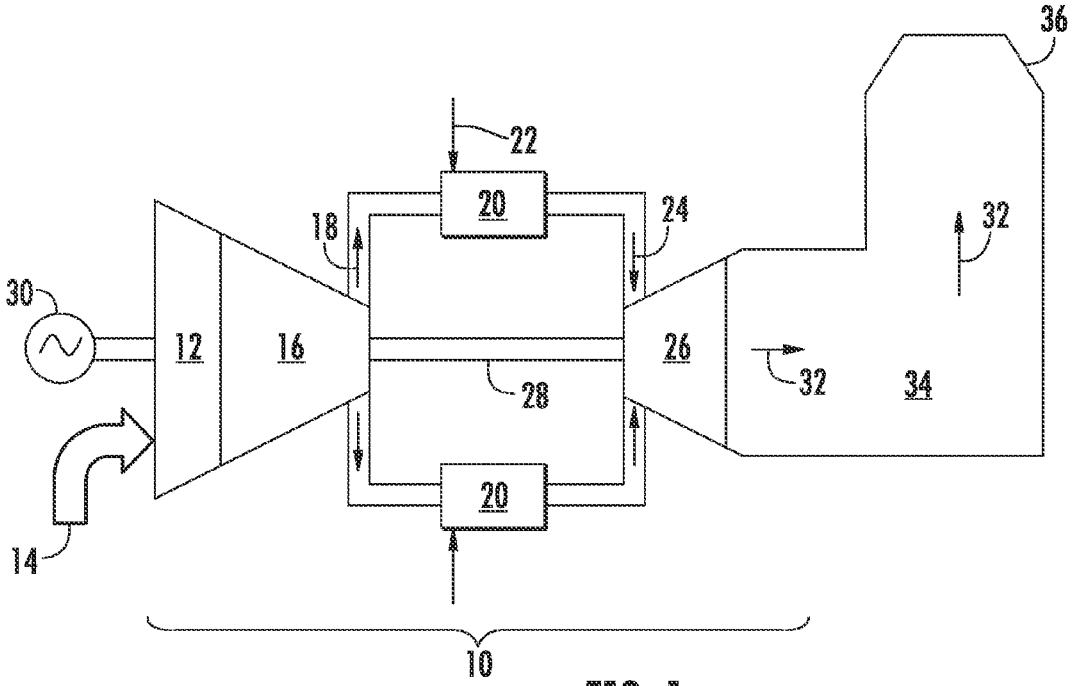
FIG. 1 provides a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbo-machine and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where a fuel 22 and the compressed working fluid 18 are mixed in each of the one or more combustors 20 to produce combustion gases 24 having a high temperature and pressure.

The combustion gases 24 flow through a turbine 26 where thermal and kinetic energy are transferred to one or more stages of turbine rotor blades (not shown) that are connected to a rotor shaft 28, thereby causing the rotor shaft 28 to rotate to produce work. For example, the rotor shaft 28 may be used to drive the compressor 16 to produce the compressed working fluid 18. Alternately or in addition, the rotor shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
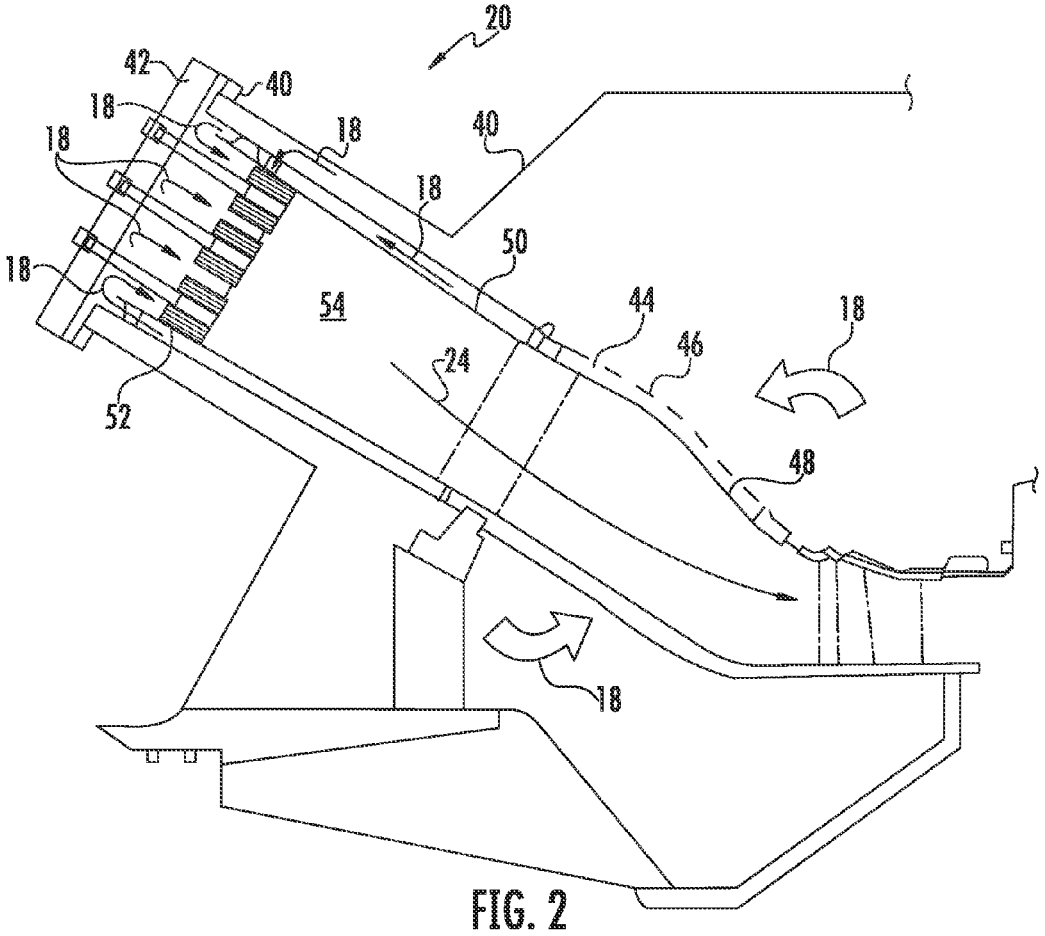
FIG. 2 provides a simplified cross-section side view of an exemplary combustor according to various embodiments of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. As shown in FIG. 2, an outer casing 40 and an end cover 42 disposed at one end of the combustor 20 may combine to contain the compressed working fluid 18 flowing to the combustor 20. The end cover 42 may be coupled to the outer casing 40 or may be coupled to the outer casing via a spacer or intermediate casing (not shown). The compressed working fluid 18 may pass through flow holes 44 in an impingement sleeve 46 to flow along the outside of a transition piece 48 and/or a liner 50 to provide convective cooling to the transition piece 48 and/or the liner 50.

The compressed working fluid 18 is routed to the end cover 42 where it reverses direction and flows through one or more bundled tube fuel injectors 52 disposed downstream from the end cover 42. Fuel is provided to the bundled tube fuel injector 52 and the fuel and the compressed working fluid are premixed or combined within the bundled tube fuel injectors 52 before being injected into a combustion chamber 54 defined within the combustor 20. The fuel and compressed working fluid mixture is burned in the combustion chamber 54 to generate the hot combustion gases 24.

Figure 3:
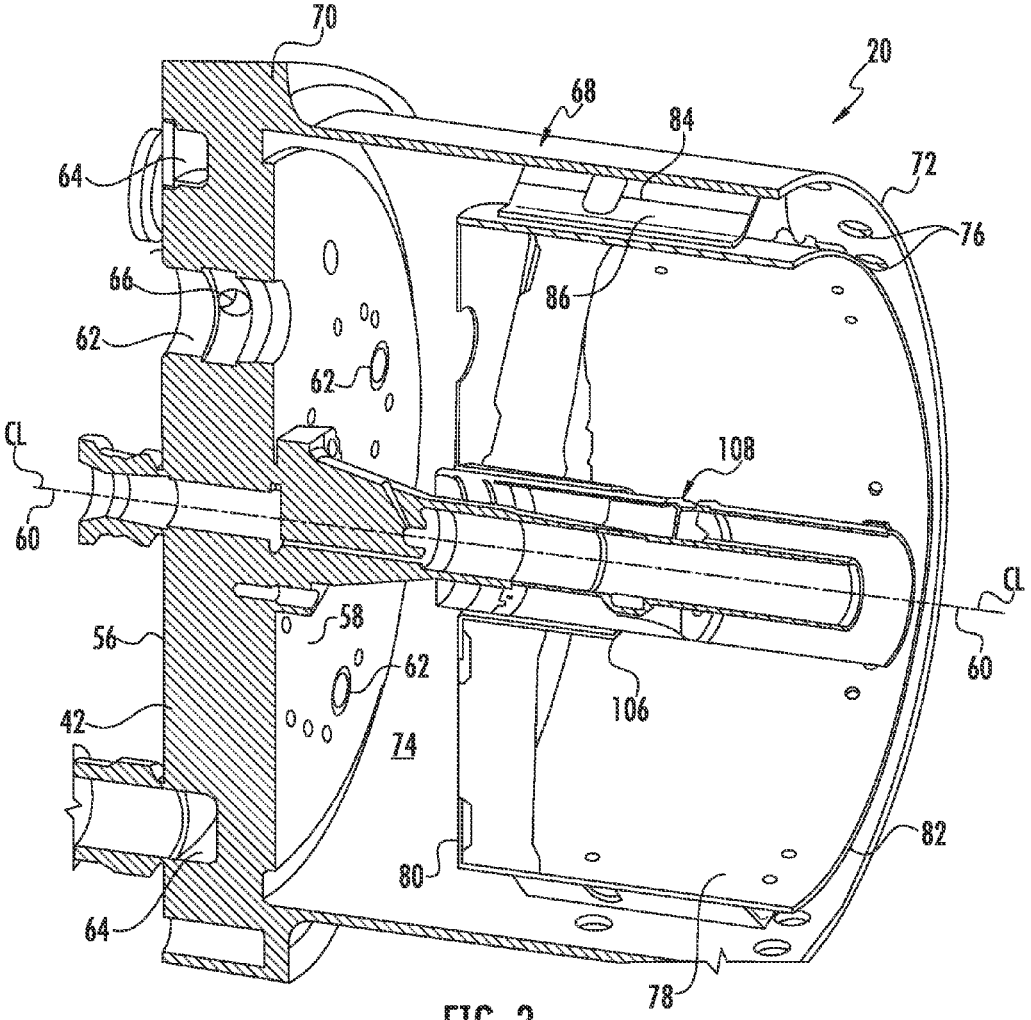
FIG. 3 provides a cross section perspective view of a portion of the combustor as shown in FIG. 2, according to various embodiments of the present disclosure.

FIG. 3 provides a cross section perspective view of a portion of the combustor 20 as shown in FIG. 2 with the bundled tube fuel injectors 52 removed for clarity, according to various embodiments of the present disclosure. As shown in FIG. 3, the end cover 42 generally includes an outer side 56 and an inner side 58. The outer side 56 is axially separated from the inner side 58 with respect to an axial centerline 60 of the end cover 42. The end cover 42 at least partially defines one or more fuel feed passages 62. In particular embodiments, the fuel feed passages 62 extend through the outer side 56 and the inner side 58. One or more fuel circuits 64 may be at least partially defined within the end cover 42. Each or some of the fuel feed passages 62 may include a fuel port 66 that provides for fluid communication between at least one of the fuel circuits 64 and the corresponding fuel feed passage 62.

In particular embodiments, the combustor 20 includes an outer barrel 68. The outer barrel 68 is generally cylindrically shaped. The outer barrel 68 includes a forward end 70 and an aft end 72. In particular embodiments, the forward end 70 is generally adjacent to the inner side 58 of the end cover 42. The aft end 72 is axially spaced from the forward end 70 with respect to the axial centerline 60. In particular embodiments, the outer barrel 68 is coaxially aligned with respect to the axial centerline 60 of the end cover 42. The outer barrel 68 may at least partially define a head end plenum 74 of the combustor 20. In particular embodiments, the forward end 70 is fixedly connected to the end cover 42. For example, the forward end 70 of the outer barrel 68 may be pinned, bolted, welded, brazed or otherwise fixedly connected to the end cover 42. In addition or in the alternative, as shown in FIG. 2, the forward end 70 may be constrained between the end cover 42 and the outer casing 40. In addition or in the alternative, the outer barrel 68 may be fixedly connected to the outer casing 40. As shown in FIG. 3, the outer barrel 68 may include a plurality of flow passages 76 that extend substantially radially through the outer barrel 68 to provide for fluid communication therethrough.

In particular embodiments, the combustor 20 includes an inner barrel 78. The inner barrel 78 may be generally cylindrically shaped. At least a portion of the inner barrel 78 is disposed within the outer barrel 68. The inner barrel 78 includes a forward end 80 that is proximate to the end cover 42 and an aft end 82 that is axially separated from the forward end 80. In particular embodiments, the inner barrel 78 is coaxially aligned with the outer barrel 68. In one embodiment, the inner barrel 78 extends concentrically within the outer barrel 68. The inner barrel 78 and the outer barrel 68 are spaced radially apart so as to define a flow passage 84 therebetween.

In particular embodiments, the inner barrel 78 is fixedly connected to the outer barrel 68. For example, the inner barrel 78 may be pinned, bolted, welded, brazed or otherwise fixedly connected to the outer barrel 68. In particular embodiments, one or more struts 86 extend between the inner barrel 78 and the outer barrel 68 within the flow passage 84. In particular embodiments, the inner barrel 78 is fixedly connected to the outer barrel via the one or more struts 86.

Figure 4:
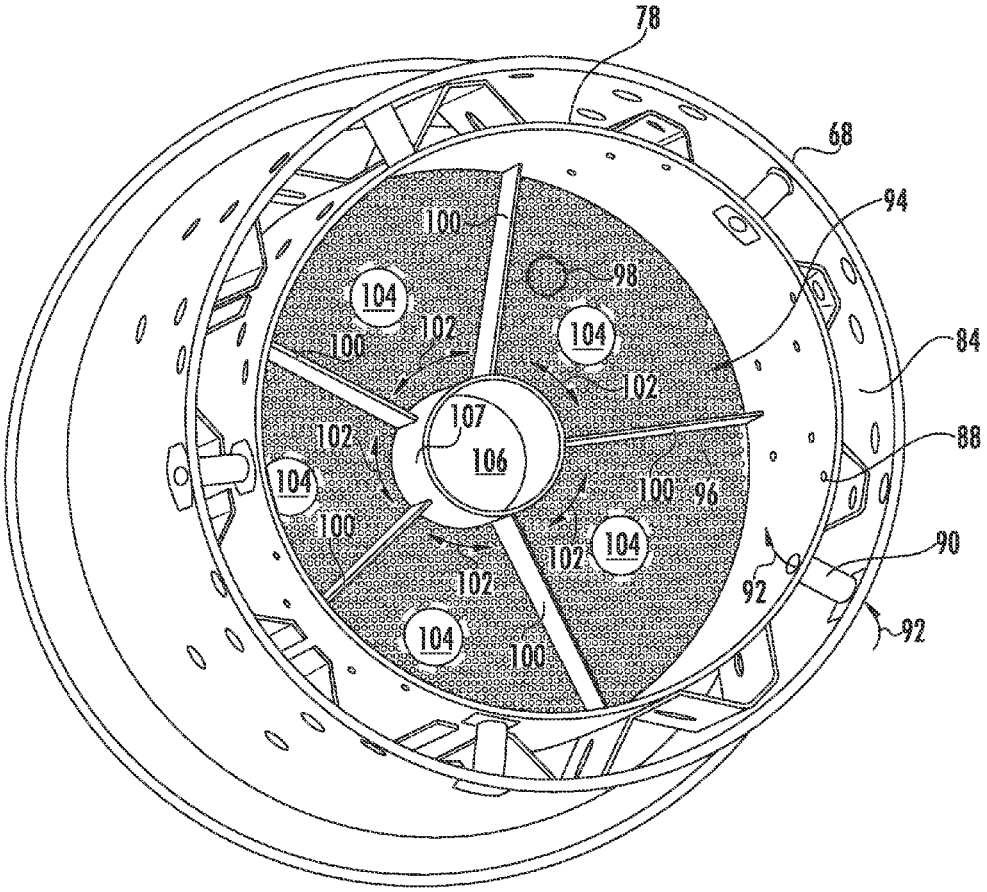
FIG. 4 provides an upstream perspective view of an outer barrel and an inner barrel, according to one embodiment of the present invention.

FIG. 4 provides an upstream perspective view of the outer barrel 68 and the inner barrel as shown in FIG. 3, according to one embodiment of the present invention. As shown in FIG. 4, the inner barrel 78 may at least partially define at least one inlet port 88 that provides for fluid communication from the flow passage 84 through the inner barrel 78. In one embodiment, a hollow strut 90 extends between the inner barrel 78 and the outer barrel 68 within the flow passage 84. The hollow strut 90 at least partially defines an inlet flow path 92 that extends through the outer barrel 68 and through the inner barrel 78.

In particular embodiments, an inlet flow conditioner 94 extends radially and circumferentially across the inner barrel generally proximate to the forward end 80. In one configuration, the inlet flow conditioner 94 generally comprises of an annular plate 96 that includes a plurality of flow holes 98 to condition or control the flow of the compressed working fluid 18 (FIG. 2) upstream from the bundled tube fuel injectors 52 (FIG. 2). As shown in FIG. 4, one or more flow separation walls 100 may divide the inlet flow conditioner 94 into a plurality of wedge shaped segments 102. In particular embodiments, a plurality of fluid conduit openings 104 extend through the annular plate 96. In particular embodiments, a fuel nozzle passage 106 is defined by an annular collar or sleeve 107 that extends generally axially through the inlet flow conditioner 94. As shown in FIG. 3, a center fuel nozzle 108 extends downstream from the inner side 58 of the end cover 42. The center fuel nozzle 108 may be substantially aligned with the axial centerline 60 of the end cover 42. The center fuel nozzle may extend generally axially through the fuel nozzle passage 106.

Figure 5:
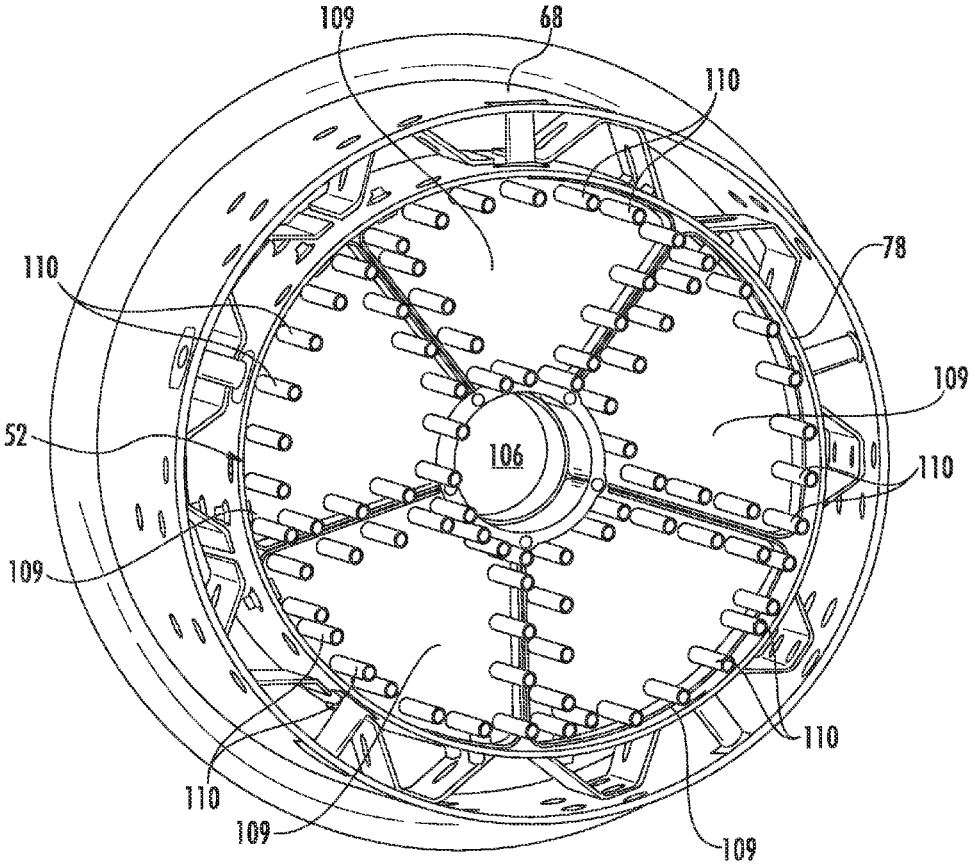
FIG. 5 provides a perspective view of the outer barrel, the inner barrel and a bundled tube fuel injector including a plurality of bundled tube fuel injector segments according to one embodiment of the present invention.

FIG. 5 provides a perspective view of the outer barrel 68, the inner barrel 78 and the bundled tube fuel injector 52 according to one embodiment of the present invention. The bundled tube fuel injector 52 may be positioned substantially concentrically within the inner barrel 78. In various embodiments, the bundled tube fuel injector 52 comprises a plurality of bundled tube fuel injector segments 109. For example, in one embodiment as shown in FIG. 5, the bundled tube fuel injector 52 comprises five generally arcuate shaped bundled tube fuel injector segments 109 arranged in an annular array around the fuel nozzle passage 106 and/or the center fuel nozzle 108 (FIG. 3) within the inner barrel 78. It should be appreciated that the bundled tube fuel injector 52 may include one or any number of the bundled tube fuel injector segments 109 depending on various factors such as the size and the type of combustor, therefore the invention should not limited to five bundled tube fuel injector segments 109.

Figure 6:
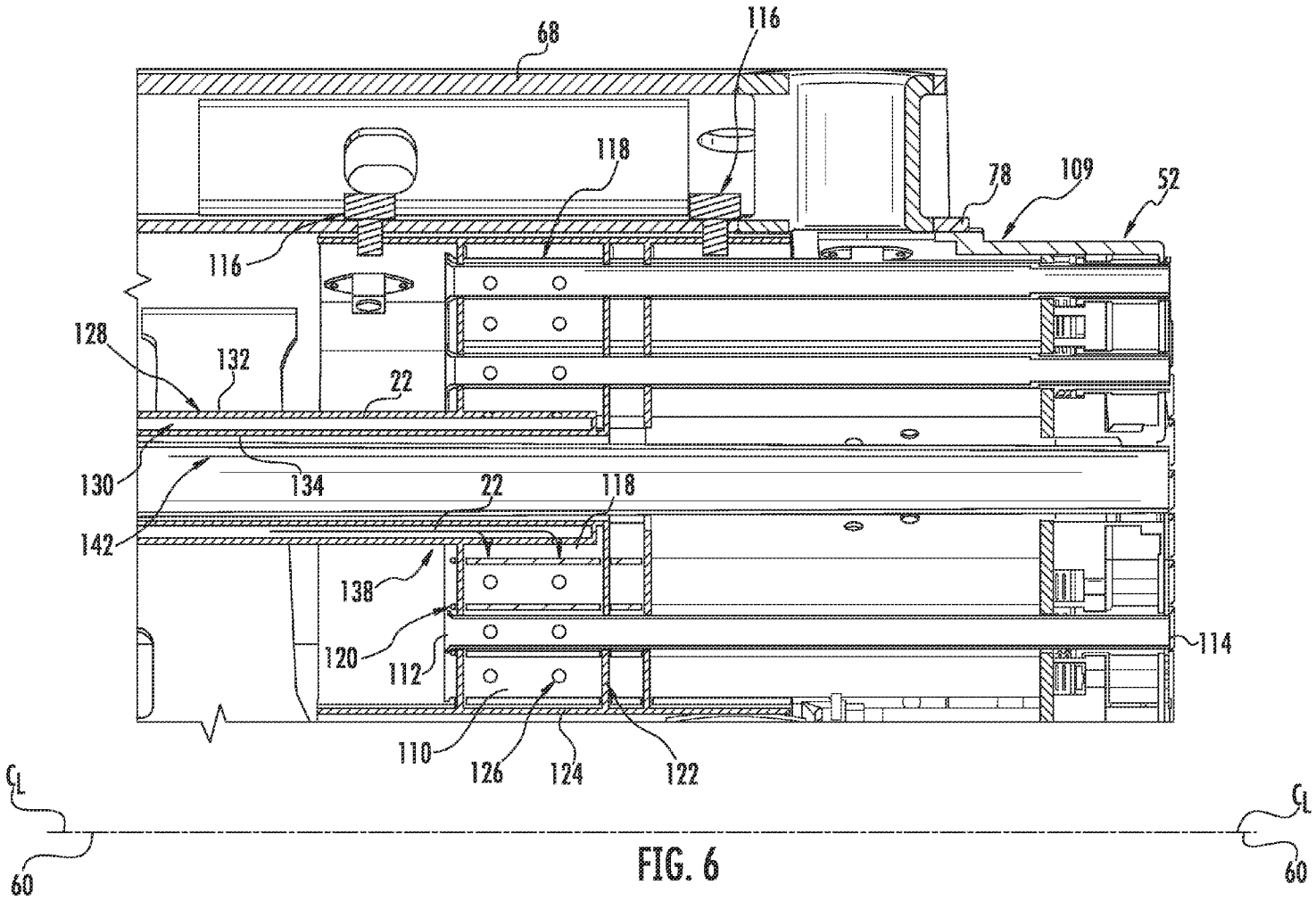
FIG. 6 provides a cross section side view of an exemplary bundled tube fuel injector segment which is representative of each of the bundled tube fuel injector segments shown in FIG. 5, according to one embodiment of the present invention.

FIG. 6 provides a cross section side view of an exemplary bundled tube fuel injector segment 109 which is representative of each of the bundled tube fuel injector segments 109 disposed within the inner barrel 78 as shown in FIG. 5, according to one embodiment of the present invention. As show in FIGS. 5 and 6, the bundled tube fuel injector segment 109 generally includes a plurality of tubes 110.

As shown in FIG. 6, the tubes 110 extend generally axially with respect to centerline 60 and the tubes 110 are substantially parallel to each other. Each tube 110 generally includes an inlet 112 defined at an upstream end and an outlet 114 defined at a downstream end. Although generally illustrated as cylindrical tubes in each embodiment, the cross-section of the tubes 110 may be any geometric shape, and the present invention is not limited to any particular cross-section unless specifically recited in the claims. The tubes 110 may be grouped in circular, triangular, square, or other geometric shapes and the tubes 110 may be arranged in various numbers and geometries.

In particular embodiments, as shown in FIG. 6, the bundled tube fuel injector segment 109 is fixedly connected to the inner barrel 78. For example, the bundled tube fuel injector segment 109 may be pinned, bolted, welded, brazed or otherwise fixedly connected to the inner barrel 68. In particular embodiments, each of the bundled tube fuel injector segments 109 are fixedly connected to the inner barrel 78, thereby providing a rigid mounting support for each bundled tube fuel injector segment 109. In one embodiment, as shown in FIG. 6, the bundled tube fuel injector segment 109 is fixedly connected to the inner barrel 78 by one or more fastener(s) 116 such as bolts or pins. The fastener(s) 116 may extend generally radially between the inner barrel 78 and the bundled tube fuel injector segment 109. The fastener(s) 116 may be held in position by weld nuts or the like. In addition or in the alternative, the bundled tube fuel injector segment 109 may be fixedly connected to the inner barrel 78 by any other suitable mechanical means such as by welding or brazing.

As shown in FIG. 6, the bundled tube fuel injector segment 109 includes a fuel plenum 118 defined therein. In particular configurations, the fuel plenum 118 may be at least partially defined between a first plate 120, a second plate 122 that is spaced axially downstream from the first plate 120 and an outer sleeve 124 that extends at least partially circumferentially around the bundled tube fuel injector 52. Both or either the first plate 120 and/or the second plate 122 may extend generally radially and circumferentially within the bundled tube fuel injector segment 109. In particular embodiments, at least some of the plurality of tubes 110 extend substantially axially through the fuel plenum 118. For example, the plurality of tubes 110 may extend generally axially through the first plate 120 and the second plate 122. Each or some of the tubes 110 may include one or more fuel ports 126 that provide for fluid communication from the fuel plenum 118 into the tubes 110.

Figure 7:
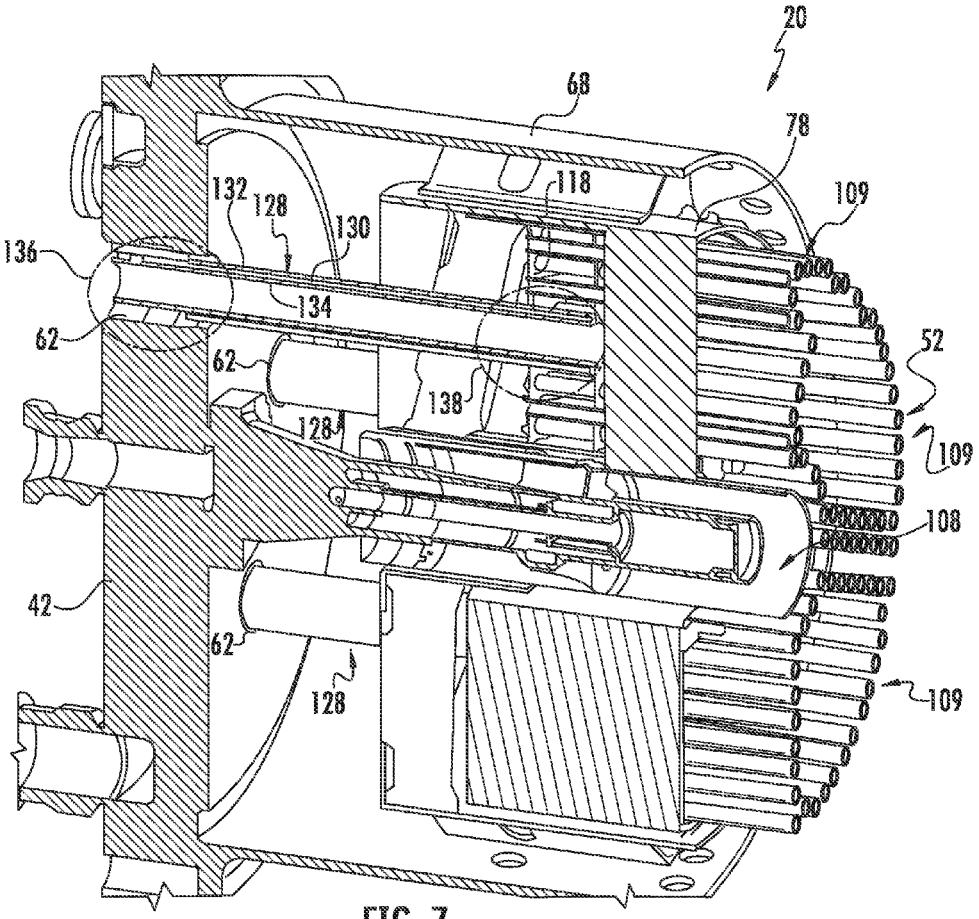
FIG. 7 provides a cross section perspective view of a portion of the combustor according to various embodiments of the present invention.

FIG. 7 provides a cross section perspective view of a portion of the combustor 20 according to various embodiments of the present invention. As shown in FIG. 7, a fluid conduit 128 extends downstream from the end cover 42 between the fuel feed passage 62 and a corresponding bundled tube fuel injector segment 109. In particular embodiments, as shown in FIGS. 6 and 7, one or more fuel passages 130 are defined within the fluid conduit 128 to provide for fluid communication between the fuel feed passage 62 (FIG. 7) and the bundled tube fuel injector segment 109. Particularly, as shown in FIG. 6, the fluid conduit 128 provides for fluid communication between the fuel feed passage 62 (FIG. 7) and the fuel plenum 118 (FIG. 6). In particular configurations, as shown in FIGS. 6 and 7, the fuel passages 130 may be at least partially defined between an outer tube 132 and an inner tube 134 that extends generally coaxially within the outer tube 132.

In particular embodiments, as shown in FIG. 7, the fluid conduit 128 includes a first portion 136 that extends within the fuel feed passage 62 and a second portion 138 as shown in FIGS. 6 and 7, that is fixedly connected to the bundled tube fuel injector segment 109. The second portion 138 may be fixedly connected to the bundled tube fuel injector segment 109 by any suitable means such as by welding or brazing. The second portion 138 may extend at least partially through the first plate 120 and/or the fuel plenum 118.

Figure 8:
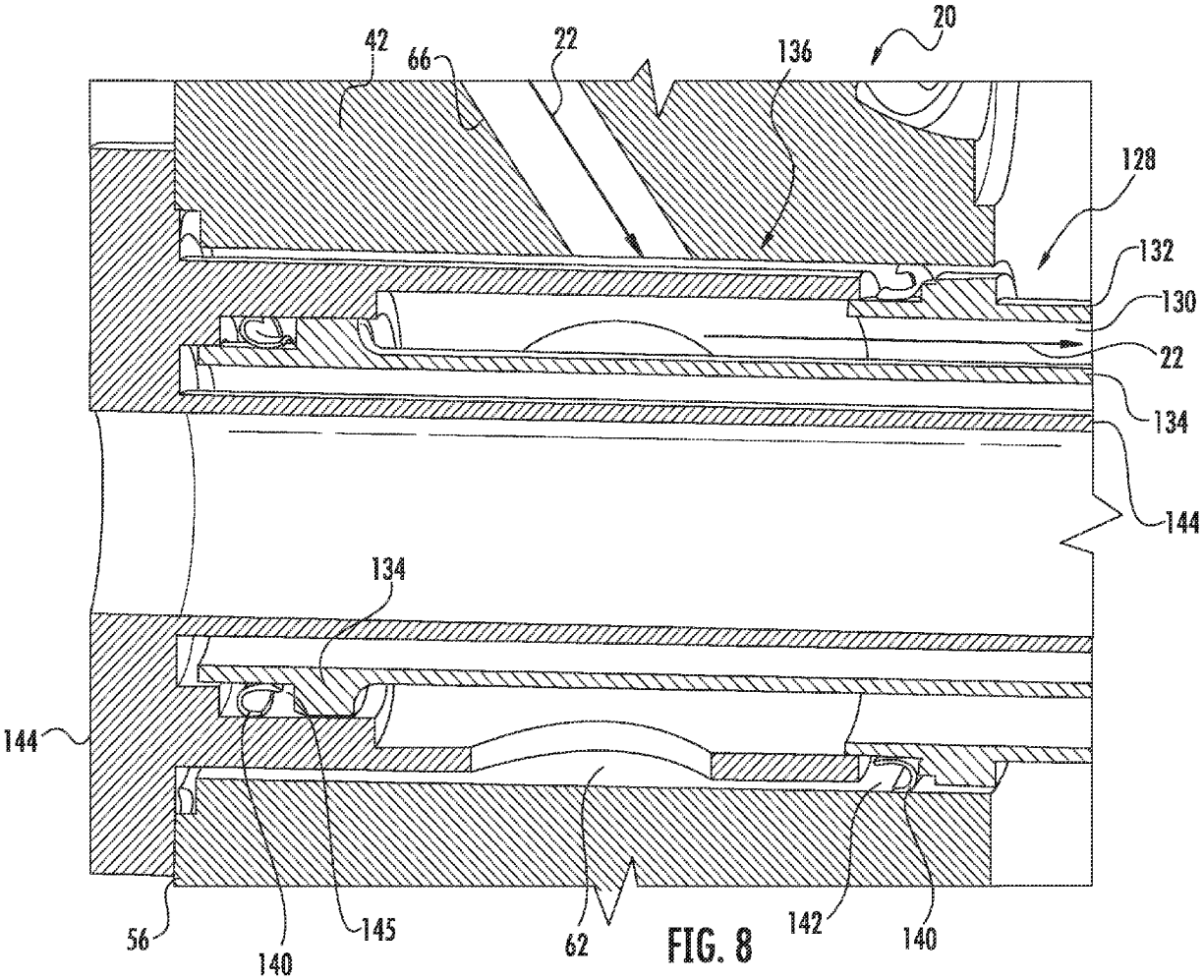
FIG. 8 provides an enlarged cross section side view of a portion of the combustor as shown in FIG. 5, according to one embodiment of the present invention.

FIG. 8 provides an enlarged cross section side view of a portion of the combustor 20 including a portion of the end cover 42, one of the fuel feed passages 62 and the first portion 136 of the fluid conduit 128 as shown in FIG. 5, according to one embodiment of the present invention. In particular embodiments, as shown in FIG. 8, the first portion 136 of the fluid conduit 128 extends at least partially through the fuel feed passage 62. As shown, the first portion 136 is generally unconstrained in the axial direction with respect to axial centerline 60 (FIG. 6). As a result, the first portion 136 of the fluid conduit 128 is slidable in the axial direction within the fuel feed passage 62 as the fluid conduit 128 expands and contracts due to thermal transients within the combustor 20. One or more annular or ring shaped seals 140 such as a lip seal or "J" seal may extend radially between the first portion 136 and the fuel feed passage 62. In particular embodiments, at least one annular seal 140 of the one or more annular seals 140 extends between the outer tube 132 and an inner surface 142 of the fuel feed passage 62.

Figure 9:
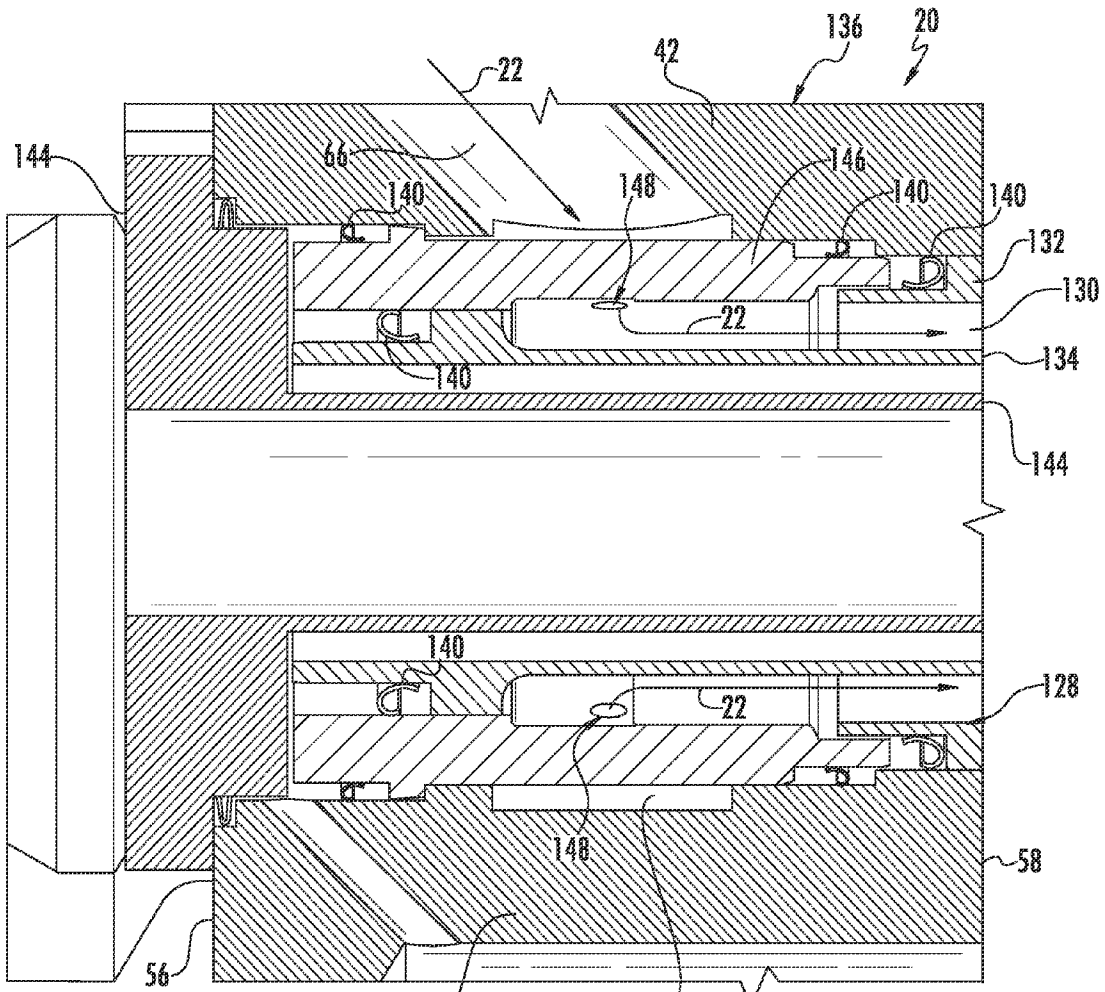
FIG. 9 provides an enlarged cross section side view of a portion of the combustor including a portion of the end cover as shown in FIG. 8, according to one embodiment of the present invention.

FIG. 9 provides an enlarged cross section side view of a portion of the combustor 20 including a portion of the end cover 42, one of the fuel feed passages 62 and the first portion 136 of the fluid conduit 128 as shown in FIG. 8, according to one embodiment of the present invention. In certain embodiments, as partially shown in FIGS. 8 and 9, an insert 144 such as a liquid fuel cartridge extends from the outer side 56 of the end cover 42 through the fuel feed passage 62 within the fluid conduit 128. As shown in FIG. 8, the insert 144 may extend generally axially within the inner tube 134. In one embodiment, as shown in FIG. 8, at least one annular seal 140 of the one or more annular seals 140 extends radially between the inner tube 134 and an inner surface 145 of the insert 144.

In operation, as illustrated in various figures, fuel 22 is routed from one the fuel circuits 64 through the fuel port 66 and into the fuel passage 130 where it is routed to the fuel plenum 118. As the combustor 20 cycles through various thermal transients, the fluid conduit 128 will expand or contract axially due to thermal expansion. Because the second portion 138 of the fluid conduit 128 is fixedly connected to the bundled tube fuel injector segment 109 and the bundled tube fuel injector segment 52 is fixedly connected to the inner barrel 78, the slidable interface between the first portion 136 of the fluid conduit 128 and the fuel feed passage 62 will accommodate for the axial growth of the fluid conduit 128. The annular seals maintain a fluid seal between the forward portion 136 of the fluid conduit 128 and the fuel feed passage 62 and/or the insert 144 as the fluid conduit expands and contracts within the fuel feed passage 62.

In one embodiment, as shown in FIG. 9, an orifice sleeve 146 is disposed concentrically within the fuel feed passage 62. The orifice sleeve 146 is generally disposed radially between inner and outer tubes 134, 132 and the fuel feed passage 62 such that at least a portion of the first portion 136 of the fluid conduit 128 extends within the orifice sleeve 146. The orifice sleeve 146 includes one or more fuel ports 148 for metering or controlling the flow of the fuel 22 between the fuel port 66 and the fuel passage 130. As shown, the first portion 136 is generally unconstrained in the axial direction with respect to axial centerline 60 (FIG. 6). As a result the first portion 136 of the fluid conduit 128 is slidable in the axial direction within the fuel feed passage 62 and within the orifice sleeve 146 as the fluid conduit 128 expands and contracts due to thermal transients within the combustor 20. As previously presented and as illustrated in various figures, because the second portion 138 of the fluid conduit 128 is fixedly connected to the bundled tube fuel injector 52 and the bundled tube fuel injector 52 is fixedly connected to the inner barrel 78, the slidable interface between the first portion 136 of the fluid conduit 128 and the fuel feed passage 62 and between the first portion 136 and the orifice sleeve 146 will accommodate for the axial growth of the fluid conduit 128.

In this configuration, at least one annular seal 140 of the one or more annular seals 140 extends radially between the first portion of the fluid conduit and the orifice sleeve 146. For example, one of the one or more annular seals 140 may extend between the outer tube 132 and the inner surface 142 of the fuel feed passage 62 and at least one of the one or more annular seals 140 may extend radially between the inner tube 134 and the orifice sleeve 146. The annular seals 140 maintain a fluid seal between the forward portion 136 of the fluid conduit 128 and the fuel feed passage 62 and/or the orifice sleeve 146 as the fluid conduit expands and contracts or translates axially within the fuel feed passage 62.

Figure 10:
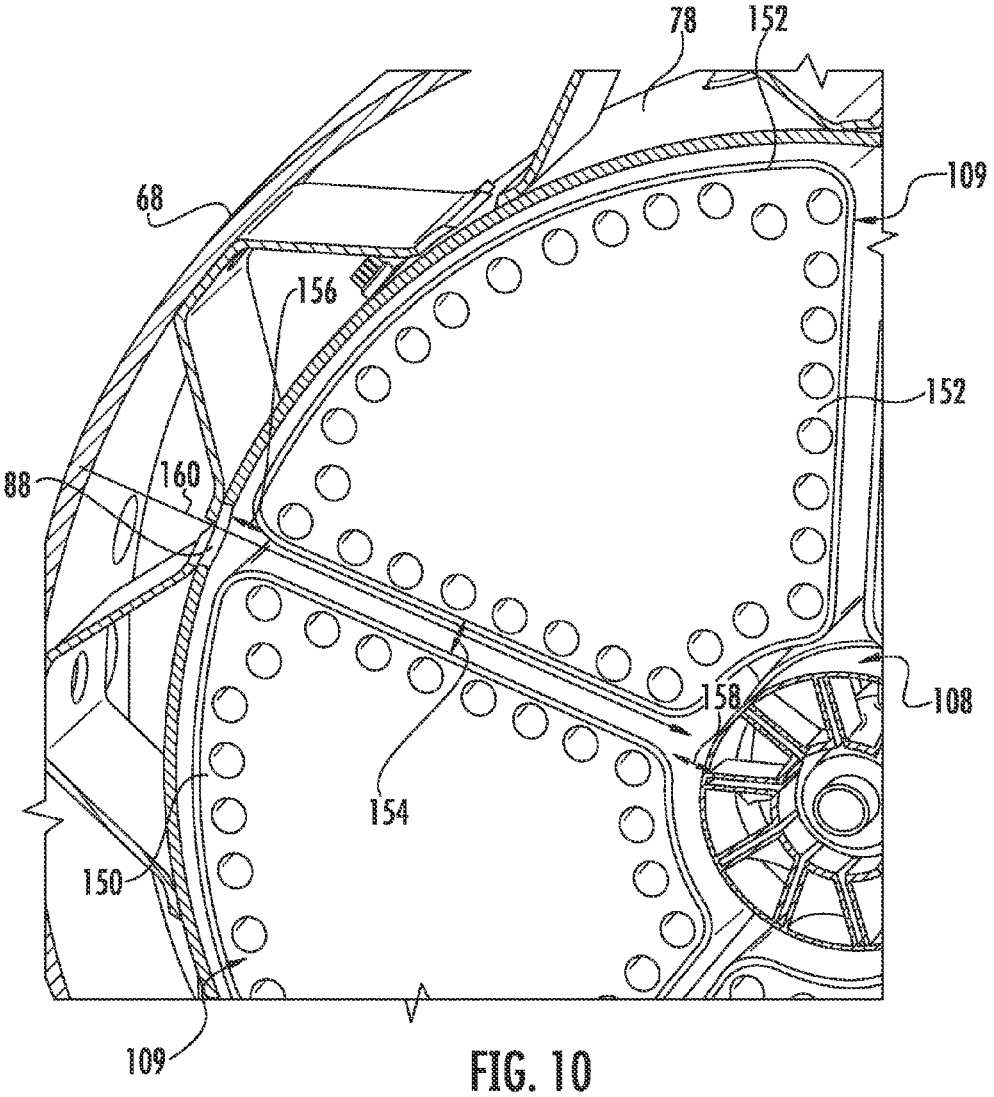
FIG. 10 provides a cross section perspective view of a portion of the combustor according to one embodiment of the present invention.
Figure 11:
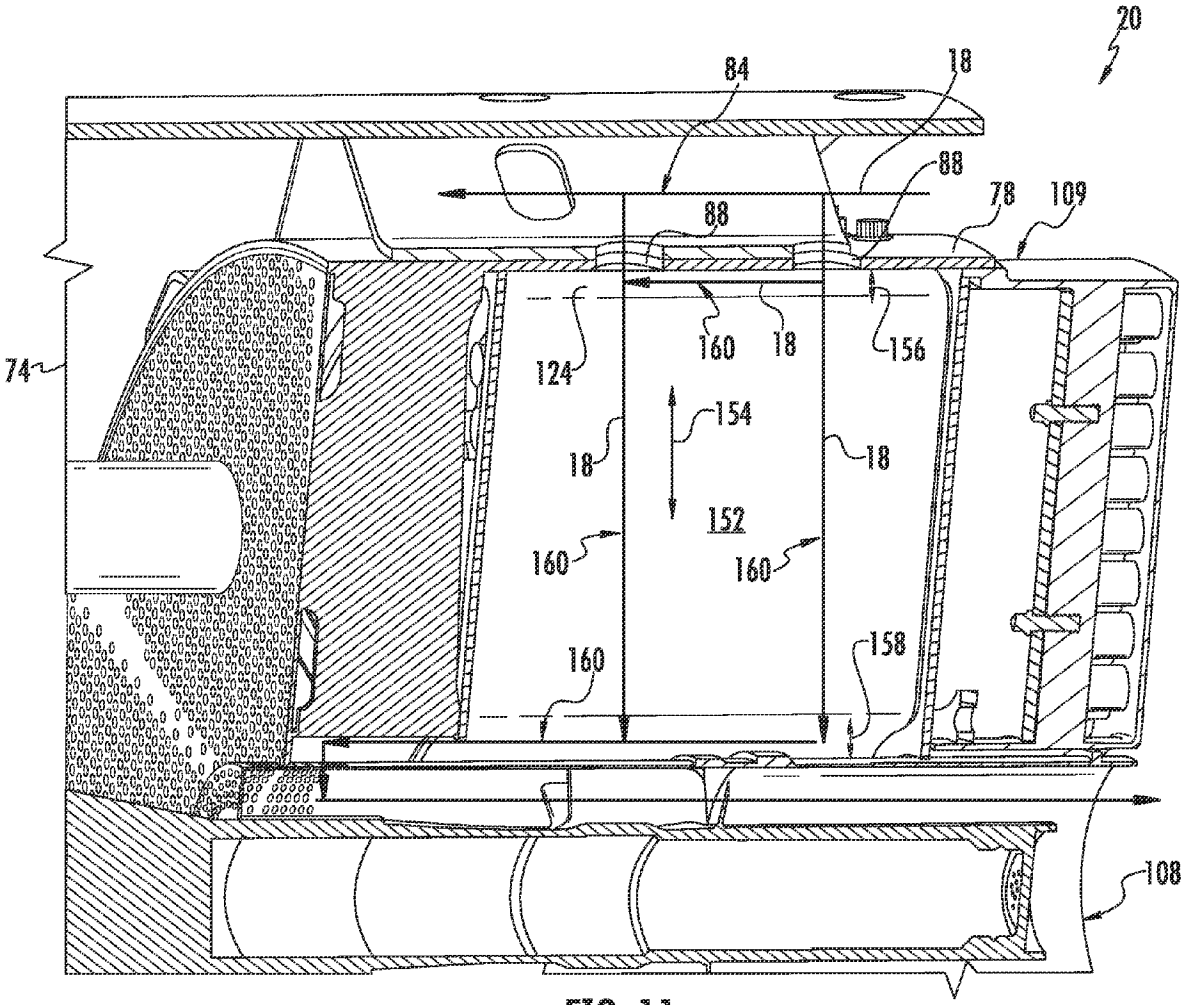
FIG. 11 provides a cross section side view of a portion of the combustor as shown in FIG. 10, according to one embodiment of the present invention.
Figure 12:
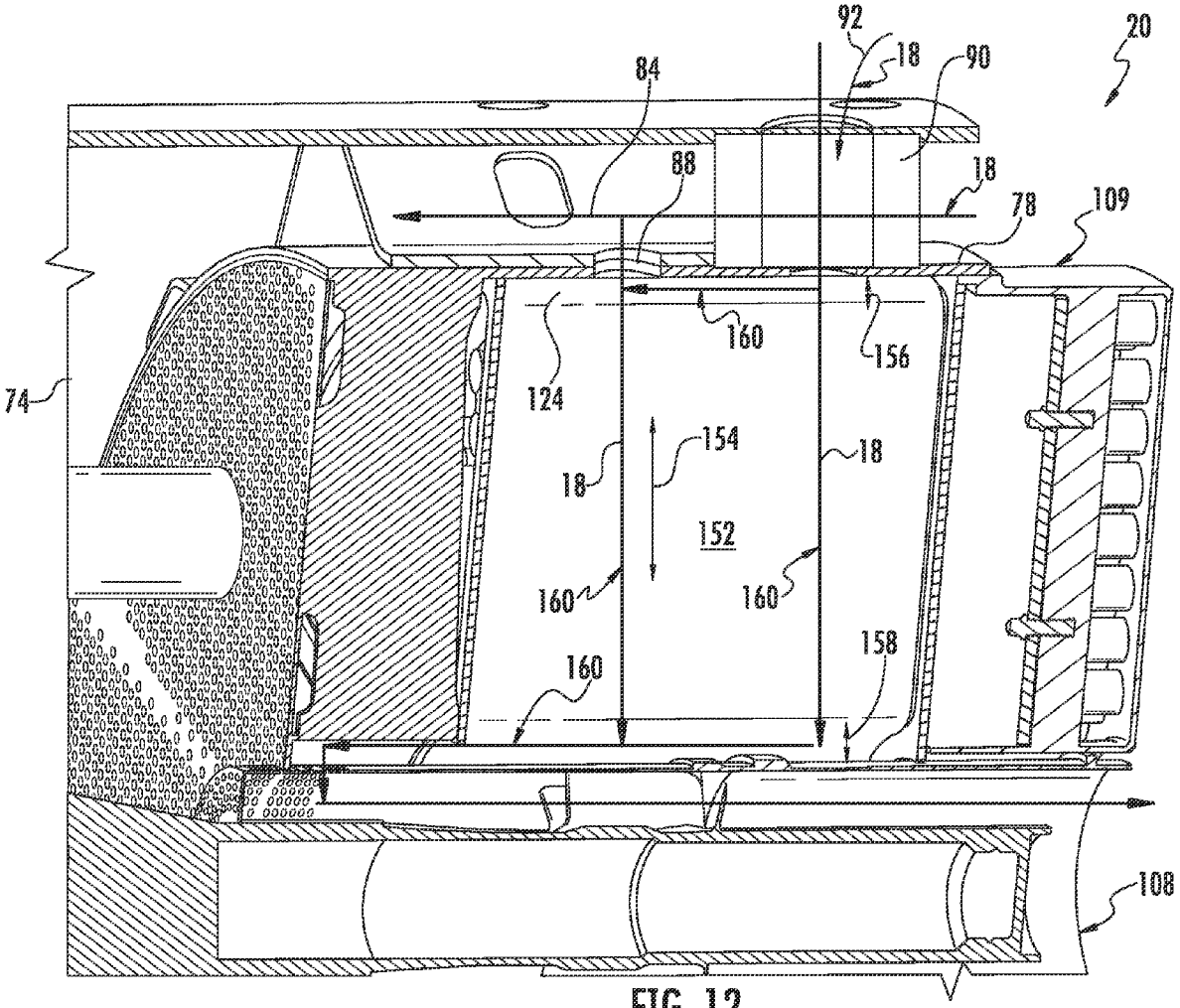
FIG. 12 provides a cross section side view of a portion of the combustor as shown in FIG. 10 according to one embodiment of the present invention.

FIG. 10 provides a cross section perspective view of a portion of the outer barrel 68, a portion of the inner barrel 78, a first bundled tube fuel injector segment 150, a second bundled tube fuel injector segment 152 posited adjacent to the and the first bundled tube fuel injector segment 150 and a portion of the center fuel nozzle 108 according to one embodiment of the present invention. FIG. 11 provides a cross section side view of a portion of the combustor 20 according to one embodiment of the present invention, and FIG. 12 provides a cross section side view of a portion of the combustor 20 according to another embodiment of the present invention. In particular embodiments, as shown in FIG. 10, a circumferential gap 154 is defined between the adjacent first and second bundled tube fuel injector segments 150, 152. As shown in FIGS. 10, 11 and 12, a first radial gap 156 may be generally defined between inner barrel 78 and the outer sleeves 124 of the first and second bundled tube fuel injector segments 150, 152. A second radial gap 158 may be defined between the center fuel nozzle 108 and the first and second bundled tube fuel injector segments 150, 152. A heated air flow path 160 is at least partially defined by one or more of the circumferential gap 154, the first radial gap 156 or the second radial gap 158. In particular embodiments, as shown in FIGS. 10 and 11, the inlet port 88 provides for fluid communication between the flow passage 84 and the heated air flow path 160. In another embodiment, as shown in FIG. 12, the heated air flow path 160 may be in fluid communication with the inlet flow path 92 at least partially defined by the hollow strut 90.

During operation of the combustor 20, as illustrated in the various figures presented herein, the temperature of the compressed working fluid 18 is generally much higher than the temperature of the fuel 22 entering the fuel plenum 118. As a result, thermal stresses may impact the durability of brazed or welded joints that are formed to provide a seal between the tubes 110 and the first and second plates 120, 122 and/or the outer sleeve 124. In addition, the rigid connection and the proximity between outer sleeves 124 of the bundled tube fuel injectors 52 and the inner barrel 78 may also contribute to thermal gradients which may also result in undesirable thermal stresses, between the outer sleeve 124 and the inner barrel 78.

The heated air flow path 160 allows for a portion of the compressed working fluid 18 or some other heating medium to be routed from the flow passage 84 or other source (not shown) across the bundled tube fuel injector segments 109, particularly the outer sleeve 124, thereby providing convective heating to the outer sleeve 154 and reducing undesirable thermal gradients between the components. The compressed working fluid 18 may then be routed into the center fuel nozzle 108 and/or into the head end plenum 74 to accommodate for any pressure loss created by the 180 degree turning of the compressed working fluid 18 that enters the head end plenum 74 from the flow passage 84. As a result, potential for flame holding at the center fuel nozzle 108 may also be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

a. an end cover disposed at one end of the combustor, the end cover having an outer side and an inner side;

b. an outer barrel having a forward end adjacent to the inner side and an aft end axially spaced from the forward end;

c. an inner barrel at least partially disposed concentrically within the outer barrel, wherein the inner barrel is fixedly connected to the outer barrel;

d. a fluid conduit that extends downstream from the end cover; and e. a first bundled tube fuel injector segment disposed within the inner barrel, the first bundled tube fuel injector segment having a fuel plenum in fluid communication with the fluid conduit and a plurality of parallel tubes that extend axially through the fuel plenum, wherein the first bundled tube fuel injector segment is fixedly connected to the inner barrel, wherein the first bundled tube fuel injector segment is radially separated from the inner barrel to at least partially define a heated air flow path therebetween.

2. The combustor as in claim 1, wherein the first bundled tube fuel injector segment is fixedly connected to the inner barrel by at least one of a plurality of fasteners, welding or brazing.

3. The combustor as in claim 1, wherein the outer barrel is fixedly connected to the end cover.

4. The combustor as in claim 1, wherein the inner barrel is spaced radially from the outer barrel to define a flow passage therebetween, the inner barrel defining an inlet port that provides for fluid communication between the flow passage and the heated air flow path.

5. The combustor as in claim 1, further comprising a hollow strut that extends between the outer barrel and the inner barrel, wherein the hollow strut at least partially defines an inlet flow path that is in fluid communication with the heated air flow path.

6. The combustor as in claim 1, further comprising a second bundled tube fuel injector segment disposed adjacent to the first bundled tube fuel injector segment and a center fuel nozzle substantially aligned with an axial centerline of the end cover, the first and the second bundled tube fuel injector segments at least partially circumferentially surrounding the center fuel nozzle, wherein the first and the second bundled tube fuel injector segments and the center fuel nozzle at least partially define the heated air flow path.

7. The combustor as in claim 6, wherein the center fuel nozzle is in fluid communication with the heated air flow path.

8. A combustor, comprising:

a. an end cover disposed at one end of the combustor, the end cover at least partially defining a fuel feed passage that extends axially therethrough;

b. an outer barrel that extends axially away from the end cover;

c. an inner barrel that extends within the outer barrel, wherein the inner barrel is fixedly connected to the outer barrel;

d. a bundled tube fuel injector segment disposed concentrically within the inner barrel, the bundled tube fuel injector segment having a fuel plenum and a plurality of parallel tubes that extend axially through the fuel plenum, wherein the bundled tube fuel injector segment is fixedly connected to the inner barrel;

e. a fluid conduit that provides for fluid communication between the fuel feed passage and the fuel plenum, the fluid conduit having a first portion that extends within the fuel feed passage and a second portion fixedly connected to the bundled tube fuel injector segment; and f. wherein the first portion is slidable within the fuel feed passage to allow for thermal growth of the fluid conduit.

9. The combustor as in claim 8, further comprising at least one annular seal that extends radially between the first portion and an inner surface of the fuel feed passage.

10. The combustor as in claim 8, further comprising an orifice sleeve disposed concentrically within the fuel feed passage, at least a portion of the first portion of the fluid conduit extending within the orifice sleeve, wherein the first portion is slidable within the orifice sleeve.

11. The combustor as in claim 10, further comprising at least one annular seal that extends radially between the first portion and an inner surface of the orifice sleeve.

12. The combustor as in claim 8, further comprising a center fuel nozzle and a plurality of the bundled tube fuel injector segments, the plurality of the bundled tube fuel injector segments being arranged in an annular array around the center fuel nozzle within the inner barrel, wherein each bundled tube fuel injector segment is fixedly connected to the inner barrel.

13. The combustor as in claim 12, wherein each bundled tube fuel injector segment is radially separated from the inner barrel and circumferentially separated from an adjacent bundled tube fuel injector segment so as to define a heated air flow path therebetween, wherein the center fuel nozzle is in fluid communication with the heated air flow path.

14. The combustor as in claim 13, wherein the inner barrel is spaced radially from the outer barrel to define a flow path therebetween, the inner barrel defining an inlet port that provides for fluid communication between the flow path and the heated air flow path.

15. The combustor as in claim 13, further comprising a hollow strut that extends between the outer barrel and the inner barrel, wherein the hollow strut at least partially defines an inlet flow path that is in fluid communication with the heated air flow path.

16. A gas turbine, comprising;

a. a compressor;

b. a combustor disposed downstream from the compressor, wherein the combustor is at least partially surrounded by an outer casing;

c. a turbine disposed downstream from the combustor; and d. wherein the combustor comprises:

i. an end cover coupled to the outer casing, the end cover having an outer side, an inner side and a fuel feed passage that extends through the outer and the inner sides;

ii. a center fuel nozzle that extends downstream from the inner side;

iii. an outer barrel that extends axially away from the end cover within the combustor;

iv. an inner barrel that extends within the outer barrel and at least partially surrounds the center fuel nozzle, wherein the inner barrel is fixedly connected to the outer barrel;

v. a bundled tube fuel injector segment disposed between the center fuel nozzle and the inner barrel, the bundled tube fuel injector segment having a fuel plenum and a plurality of parallel tubes that extend axially through the fuel plenum, wherein the bundled tube fuel injector segment is fixedly connected to the inner barrel;

vi. a fluid conduit that provides for fluid communication between the fuel feed passage and the fuel plenum, the fluid conduit having a first portion that extends within the fuel feed passage and a second portion fixedly connected to the bundled tube fuel injector segment; and vii. wherein the first portion is slidable within the fuel feed passage to allow for thermal growth of the fluid conduit.

17. The gas turbine as in claim 16, wherein the bundled tube fuel injector segment is fixedly connected to the inner barrel by at least one of a plurality of fasteners, welding or brazing.

18. The gas turbine as in claim 16, wherein the combustor comprises a plurality of the bundled tube fuel injector segments arranged in an annular array around the center fuel nozzle within the inner barrel, wherein each bundled tube fuel injector segment is fixedly connected to the inner barrel.

19. The gas turbine as in claim 18, wherein each bundled tube fuel injector segment is radially separated from the inner barrel and circumferentially separated from an adjacent bundled tube fuel injector segment to define a heated air flow path therebetween, wherein the center fuel nozzle is in fluid communication with the heated air flow path.

* * * * *